United States Patent [19]

Holden

[11] Patent Number: 4,756,100

[45] Date of Patent: Jul. 12, 1988

[54] CROSS COUNTRY SKI TRACK GROOMING DEVICE

[76] Inventor: Thomas R. Holden, Rte. 1, Box 112, Le Center, Minn. 56057

[21] Appl. No.: 72,750

[22] Filed: Jul. 13, 1987

[51] Int. Cl.[4] ..... E01C 19/22

[52] U.S. Cl. ..... 37/220; 172/393; 280/12 R; 280/28

[58] Field of Search ..... 37/219–224, 37/263; 172/393, 787, 188, 387; 404/118; 280/13, 12 R, 12 E, 12 L, 28

[56] References Cited

U.S. PATENT DOCUMENTS

| | | | |
|---|---|---|---|
| 428,658 | 5/1890 | Week | 37/220 |
| 851,199 | 4/1907 | Doyle | 37/220 |
| 3,915,239 | 10/1975 | Hendrichon | 37/221 |
| 4,014,116 | 3/1977 | Baechler | 37/221 |
| 4,058,913 | 11/1977 | Esquilat | 37/221 |
| 4,083,131 | 4/1978 | Auer | 37/219 |
| 4,110,919 | 9/1978 | Henrichon | 37/221 |
| 4,122,614 | 10/1978 | Cheney | 37/220 |
| 4,523,398 | 6/1985 | Scheibel et al. | 37/220 |
| 4,560,303 | 12/1985 | Haug et al. | 37/219 |

*Primary Examiner*—Eugene H. Eickholt

*Attorney, Agent, or Firm*—Burd, Bartz & Gutenkauf

[57] ABSTRACT

A cross country ski grooming device comprising a track sled adapted to be towed by a vehicle in the direction of the track and having a pair of spaced apart tracking elements on the underside of the sled oriented in the direction of the track. Each tracking element comprises an elongated body which is trapezoidal in cross section and has a pointed wedge at its front end. The present invention lies in the improvement of the structure of the tracking elements by displacing the forward wedge tips away from the longitudinal center line of each tracking element in the direction toward the space between the tracking elements. This reduces the amount of snow passing between the tracking elements as the device is moved through the snow, eliminating objectionable compacting of the center ridge between the ski tracks.

12 Claims, 1 Drawing Sheet

CROSS COUNTRY SKI TRACK GROOMING DEVICE

BACKGROUND OF THE INVENTION

1. Field of the Invention

This invention is directed to devices for establishing and grooming cross country ski trails in snow. More particularly, the invention is directed to a new and improved tracking element or shoe forming an essential component of ski track grooming devices to minimize compaction of snow in the area of the center ridge formed between parallel spaced apart ski tracks.

2. The Prior Art

Baechler U.S. Pat. No. 4,014,116 discloses a ski trail grooming device including a sled adapted to be towed by a vehicle and having a pair of parallel spaced apart tracking elements on the underside of the sled and oriented in the direction of the track. Each of these track elements is elongated and trapezoidal in cross-section and is wedge shaped at its front end. The track elements of each pair are of identical symmetrical structure and interchangeable, the pointed tip of each front wedge lying on the longitudinal center line of the element.

Scheibel U.S. Pat. No. 4,523,398 and Haug U.S. Pat. No. 4,560,303 both relate to trail grooming equipment and have track elements similar to those of Baechler. All of the devices of the prior art having symmetrical track elements have a common disadvantage in that in deep snow an excess amount of snow is directed into the area between the parallel ski tracks. The underside of the sled carrying the tracking elements, because of the weight exerted by the sled, causes the center ridge to be compacted, hard and icy. The present invention is directed to alleviation of this disadvantage of the prior art devices.

SUMMARY OF THE INVENTION

A cross country ski track grooming device comprises a track sled adapted to be towed by a vehicle in the direction of the track, and a pair of parallel spaced apart tracking elements on the underside of the sled which are oriented in the direction of the track. Each of the track elements is elongated and trapezoidal in cross section with the broad base of the element being rigidly secured to the underside of the sled. Each tracking element has a height equal to the desired depth of the ski track and each tracking element has a wedge shaped front end coming to a point. The improved tracking elements according to the present invention, instead of being symmetrical as in the prior art, are non-symmetrical with the pointed tips of the front wedges of the tracking elements being displaced from the longitudinal center line of each tracking element in the direction toward the space between the tracking elements. As the track grooming device is being used, the improved non-symmetrical track elements of the present invention divert snow from the space between the tracking elements avoiding buildup of snow in that area and resulting compaction.

BRIEF DESCRIPTION OF THE DRAWINGS

The invention is illustrated by the accompanying drawings in which corresponding parts are identified by the same numerals and in which.

DETAILED DESCRIPTION OF THE PREFERRED EMBODIMENT

Figure 1:
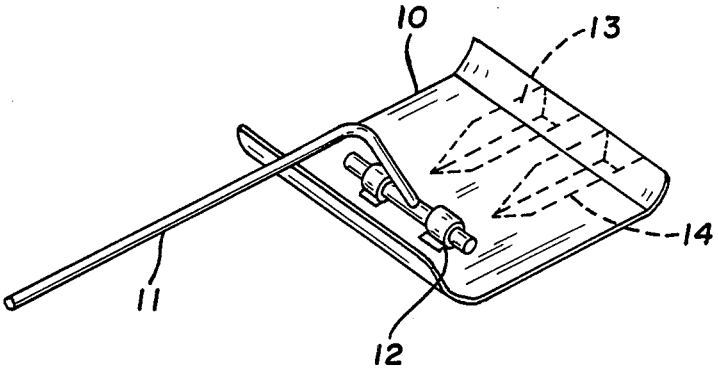
FIG. 1 is a perspective view of a trail grooming sled generally according to the prior art.
Figure 2:
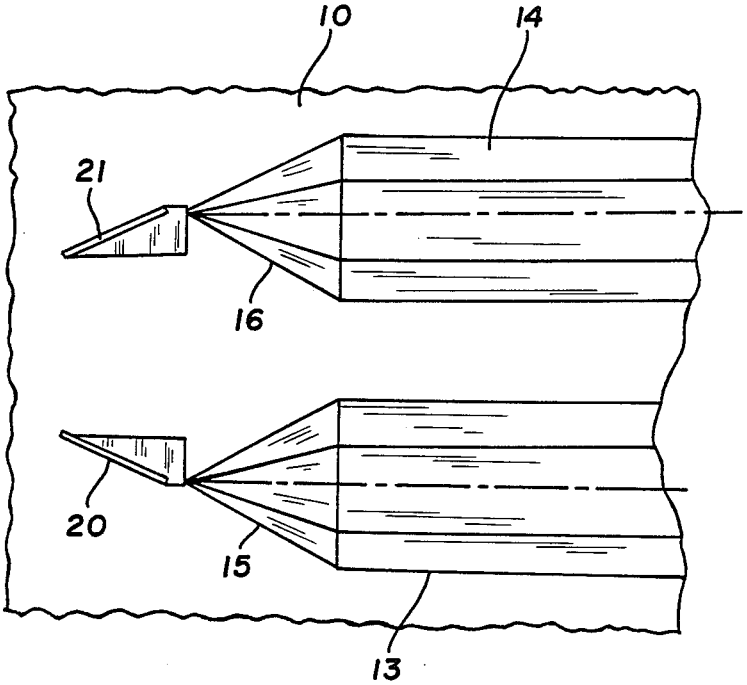
FIG. 2 is a bottom plan view of a sled such as shown in FIG. 1, showing additionally prior art means for reducing center ridge buildup.

Referring now to the drawings, and particularly to FIGS. 1 and 2, there is shown in simplified form a tracking sled 10 in the form of a generally rectangular plate, the top surface of which is intended to carry weight sufficient to force the sled down into the snow in which a cross country ski trail is formed. The sled 10 is adapted to be connected by a tow bar 11, pivotally attached to the sled at 12, to connect the sled 10 to a tractor or snowmobile or similar vehicle to pull the sled through the snow.

As best seen in FIG. 2, a pair of tracking elements 13 and 14 are attached to the underside of sled 10. Tracking elements 13 and 14 are of identical symmetrical structure. Each is an elongated rigid body which is trapezoidal in cross section and attached, as by bolts or equivalent fastening means, to the under surface of sled 10 on the broad base side of the element. The tracking elements are parallel and spaced apart. The front end of each tracking element 13 and 14 is in the form of a wedge 15 and 16, respectively. The tracking elements 13 and 14 are symmetrical and the forward pointed ends of wedges 15 and 16 lie generally along the longitudinal center lines of the tracking element bodies. The height of each tracking element is equal to the desired depth of the ski track desired to be formed in deep snow.

Figure 5:
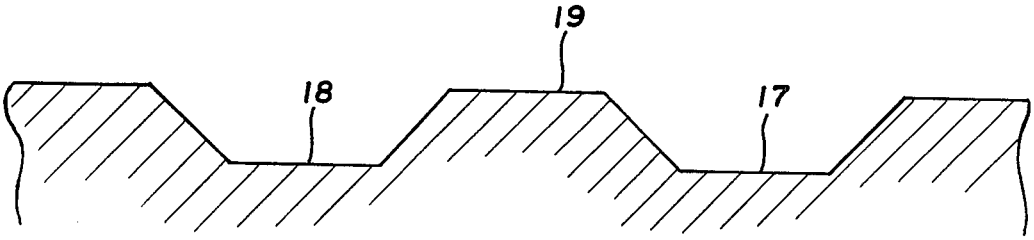
FIG. 5 is a cross section through a cross country ski trail made by use of the present invention.

As seen in FIG. 5, when the sled is pulled through deep snow, tracking elements 13 and 14 produce tracks 17 and 18, respectively, in the snow. The tracks 17 and 18 are of the same general trapezoidal cross section as are the tracking elements. A center ridge 19 is formed between the tracks. When the snow is deeper than the height of the tracking elements, then because of the symmetrical configuration of the tracking elements, an excess of snow is forced into the area between the spaced apart tracking elements. The weight of the sled causes the excess snow forming the center ridge 19 to become undesirably compacted between the bottom surface of the sled and the sides of the tracking elements. This causes a void of snow pack along the outside of the ridge and contributes to faster breakdown of the trail. Compaction also causes the center ridge to become hard and icy and a hazard to the skiers using the trail.

As seen in FIG. 2, one prior art means of avoiding the undesirable buildup and compacting of snow in the center ridge of the ski trail is to provide diverter plates or blades 20 and 21 immediately forward of the pointed tips of the wedges of tracking elements 13 and 14, respectively. The diverter plates or blades extend generally vertically downwardly from the underside of sled 10. They are disposed in mirror image relationship with their rearward edges immediately forward of the tips of wedges 15 and 16 and with the forward edges of the diverter blades extending angularly inwardly. Thus, when the sled is towed through the snow, a portion of the snow which ordinarily would pass between the tracking elements is diverted to the outside edges of the tracking elements. The present invention accomplishes the same result without use of the diverter plates or blades.

Figure 3:
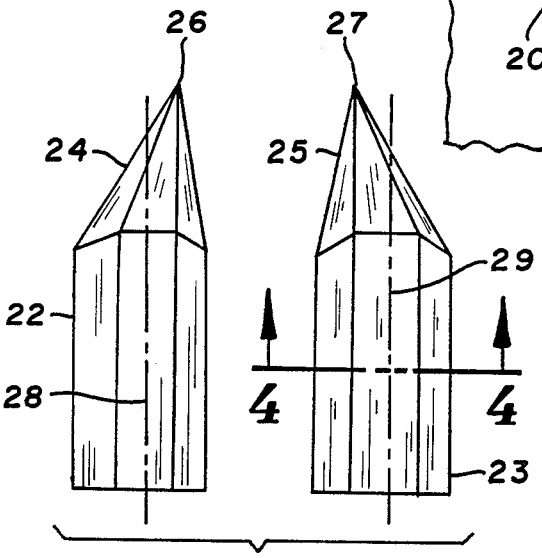
FIG. 3 is a bottom plan view similar to FIG. 2 showing the improved tracking elements according to the present invention.
Figure 4:
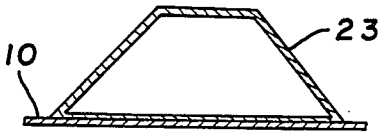
FIG. 4 is a section on the line 4—4 of FIG. 3 and in the direction of the arrows.

The improved tracking element structure which comprises the present invention is shown in FIG. 3. A pair of parallel spaced apart non-symmetrical tracking elements 22 and 23 are provided for attachment to the underside of a track sled in the same manner as previously described with respect to the prior art tracking elements. Tracking elements 22 and 23 are elongated and have a trapezoidal cross section. The forward end of each of tracking elements 22 and 23 is in the form of a wedge shaped element 24 and 25, respectively.

The surfaces of the wedge shaped members 24 and 25 taper inwardly non-symmetrically to a forward pointed tip 26 and 27, respectively. Forward wedge tips 26 and 27 are spaced inwardly from the respective longitudinal center lines 28 and 29 of tracking elemnts 22 and 23. The tracking elements lie in spaced apart non-symmetrical mirror image relationship to one another. The forward pointed tips 26 and 27 are displaced from the respective center lines 28 and 29 in the direction of the space between the tracking elements by a distance of about two to six inches. Preferably about one-third of the snow is diverted inwardly by each wedge tip and about two-thirds is diverted outwardly.

When the improved trail grooming device is towed through snow, a portion of the snow which would otherwise pass between the tracking elements is diverted to the outside surfaces of the tracking elements reducing the amount of snow forming the center ridge between the ski tracks. This reduced volume of snow in the center ridge does not become hard and compacted and the disadvantage of the symmetrical tracking element of the prior art devices is eliminated. The snow forming the walls of the ski tracks is more uniformly compacted. This contributes to greater durability of the trail.

The tracking elements 24 and 25 may be made, for example, from welded steel plate, preferably coated on their outer surfaces with a friction reducing synthetic resinous material, such as nylon. Alternatively, the tracking elements may be formed by molding in one piece, such as fiber glass reinforced nylon or polyester, or the liie. The improved tracking elements may be adapted for retrofitting of prior art trail grooming devices.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. In a cross country ski track grooming device comprising (A) a track sled adapted to be towed by a vehicle in the direction of the track, and (B) a pair of parallel spaced apart tracking elements on the underside of the sled and oriented in the direction of the track, each of said track elements:

(1) being elongated and trapezoidal in cross section with the broad base being rigidly secured to the underside of the sled, (2) having a height equal to the desired depth of ski track, and (3) being wedge shaped at the front end, coming to a pointed tip, (C) the improvement which consists in the track elements being non-symmetrical, the tips of said tracking element front wedges being displaced from the longitudinal center line of each tracking element in the direction toward the space between the tracking elements.

2. A cross country ski track grooming device according to claim 1 wherein said wedge tips are displaced from the longitudinal center lines of the tracking elements by a distance of about 2 to 6 inches whereby about one-third of the snow is diverted between the tracking elements and about two-thirds is diverted outside of the tracking elements.

3. A cross country ski track grooming device according to claim 1 wherein the tracking elements are one piece molded shells formed from a synthetic resinous plastic material.

4. A cross country ski track grooming device according to claim 3 wherein the tracking elements are formed from nylon.

5. A cross country ski track grooming device according to claim 1 wherein the tracking elements are formed from steel plate coated with a friction reducing synthetic resinous plastic material.

6. A cross country ski track grooming device according to claim 5 wherein the coating material is nylon.

7. A tracking element for a cross country ski track grooming device comprising:

(A) an elongated body trapezoidal in cross section adapted to be secured by its broad base to the underside of a track sled, and having a height equal to the desired depth of ski track, (B) a wedge at the front end of said body tapering from a forward pointed tip to the narrow base and non-parallel sides of the body, said forward tip being offset from the longitudinal center line of the elongated body.

8. A tracking element according to claim 7 wherein said wedge tip is displaced from the longitudinal center line of the tracking element by a distance of about 2 to 6 inches whereby about one-third of the snow is diverted to one side of the tracking element and about two-thirds is diverted to the other side of the tracking element.

9. A tracking element according to claim 7 wherein said element is a one-piece molded shell formed from a synthetic resinous plastic material.

10. A tracking element according to claim 9 wherein said element is formed from nylon.

11. A tracking element according to claim 7 wherein said element is formed from steel plate coated with a friction reducing synthetic resinous plastic material.

12. A cross country ski track grooming device according to claim 11 wherein the coating material is nylon.

* * * * *